US009318827B2

(12) United States Patent
Osada et al.

(10) Patent No.: US 9,318,827 B2
(45) Date of Patent: Apr. 19, 2016

(54) CONNECTOR

(71) Applicant: Yazaki Corporation, Tokyo (JP)

(72) Inventors: Takeshi Osada, Shizuoka (JP); Noritaka Nishiyama, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/661,127

(22) Filed: Mar. 18, 2015

(65) Prior Publication Data

US 2015/0194757 A1 Jul. 9, 2015

Related U.S. Application Data

(63) Continuation of application No. PCT/JP2013/074485, filed on Sep. 11, 2013.

(30) Foreign Application Priority Data

Sep. 21, 2012 (JP) ..... 2012-207779

(51) Int. Cl.
*H01R 13/15* (2006.01)
*H01R 13/422* (2006.01)
*H01R 13/533* (2006.01)

(52) U.S. Cl.
CPC ..... *H01R 13/15* (2013.01); *H01R 13/4223* (2013.01); *H01R 13/533* (2013.01)

(58) Field of Classification Search
CPC ..... H01R 13/15; H01R 13/4223; H01R 31/08
USPC ..... 439/595, 721, 723
See application file for complete search history.

(56) References Cited

U.S. PATENT DOCUMENTS 5,000,699 A * 3/1991 Nadin ..... H01R 31/08 439/189
5,201,667 A * 4/1993 Endo ..... H01R 31/08 439/189
5,403,204 A * 4/1995 Chishima ..... H01R 31/08 439/189

(Continued)

FOREIGN PATENT DOCUMENTS

JP 2005-158418 A 6/2005
JP 3804489 B2 8/2006

(Continued)

OTHER PUBLICATIONS

International Search Report of PCT/JP2013/074485 dated Dec. 10, 2013 [PCT/ISA/210].

*Primary Examiner* — Ross Gushi
(74) *Attorney, Agent, or Firm* — Sughrue Mion, PLLC

(57) ABSTRACT

A connector includes a substantially box-shaped housing, a female terminal inserted inside the housing, and a busbar supported by the housing. The housing includes a terminal housing chamber in which the female terminal is accommodated, a locking arm having elasticity, and a guide wall which guides the busbar within the housing. The locking arm includes a first securing section at which one end side is secured, a second securing section at which the other end side is secured, and an arm section connecting the first securing section and the second securing section. A linking part provided in a linked manner from the guide wall is integrally formed with the second securing section. The distance between the first securing section and the second securing section is set as the distance at which the elastic force of the locking arm is the desired elastic force.

2 Claims, 3 Drawing Sheets

(56) References Cited

U.S. PATENT DOCUMENTS 5,456,617 A * 10/1995 Chishima ..... H01R 31/08 439/189
5,496,188 A * 3/1996 Okamura ..... H01R 31/08 439/189
5,662,487 A * 9/1997 Okamura ..... H01R 31/08 29/876
5,749,753 A * 5/1998 Chishima ..... H01R 13/113 439/752.5
5,769,650 A * 6/1998 Aoyama ..... H01R 13/4365 439/189
5,788,519 A * 8/1998 Stern ..... H01R 31/085 439/189
6,193,549 B1 * 2/2001 Suzuki ..... H01R 13/4223 439/511
6,276,964 B1 * 8/2001 Shinozaki ..... H01R 13/424 439/595
6,645,003 B2 * 11/2003 Yoshida ..... H01R 29/00 439/507
6,769,934 B2 * 8/2004 Nakamura ..... H01R 13/4223 439/595
6,840,820 B2 * 1/2005 Oda ..... H01R 13/518 439/721
6,878,017 B2 * 4/2005 Sakurai ..... H01R 31/06 439/723
6,948,986 B2 * 9/2005 Kojima ..... H01R 13/432 439/595
7,104,841 B2 * 9/2006 Fukatsu ..... H01R 13/5208 439/275
7,118,423 B2 * 10/2006 Kobayashi ..... H01R 31/085 439/638
7,241,168 B2 * 7/2007 Sakurai ..... H01R 31/085 439/511
7,306,486 B2 * 12/2007 Takeda ..... H01R 13/4223 439/352
7,332,674 B2 * 2/2008 Peterson ..... H01R 4/185 174/74 R
7,351,085 B2 * 4/2008 Tamagawa ..... H01R 12/592 439/189
7,384,309 B1 * 6/2008 Morello ..... H01R 13/4226 29/858
7,396,255 B2 * 7/2008 Morello ..... H01R 13/4223 439/595
7,476,113 B2 * 1/2009 Tamagawa ..... H01R 12/592 439/189
7,481,682 B2 * 1/2009 Murakami ..... H01R 4/185 439/701
7,520,767 B2 * 4/2009 Tamagawa ..... H01R 12/592 439/189
7,862,374 B2 * 1/2011 Ichio ..... H01R 13/4223 439/595
7,883,362 B2 * 2/2011 Ichio ..... H01R 13/40 439/511
7,980,872 B1 * 7/2011 Smutny ..... H01R 13/4361 439/189
8,025,538 B2 * 9/2011 Hara ..... H01R 4/64 439/723
8,083,543 B2 * 12/2011 Omori ..... H01R 13/4223 439/511
8,100,730 B2 * 1/2012 Hara ..... H01R 4/64 439/721
8,137,116 B2 * 3/2012 Omori ..... H01R 4/64 439/883
8,182,286 B2 * 5/2012 Tamagawa ..... H01R 13/5213 439/587
8,257,111 B1 * 9/2012 Smutny ..... H01R 13/5208 439/511
8,992,251 B2 * 3/2015 Smutny ..... H01R 31/08 439/511
9,077,106 B2 * 7/2015 Suzuki ..... H01R 13/6272
9,083,094 B2 * 7/2015 Teramoto ..... H01R 4/64
9,099,803 B2 * 8/2015 Omori ..... H01R 13/5219
9,172,193 B2 * 10/2015 Sakamoto ..... H01R 24/28 439/511
9,211,852 B2 * 12/2015 Omori ..... H01R 4/64
9,214,775 B2 * 12/2015 Watanabe ..... H01R 31/08
2003/0036308 A1 * 2/2003 Fukuda ..... H01R 13/6456 439/595
2003/0060075 A1 3/2003 Nakamura et al.
2005/0026480 A1 * 2/2005 Fujii ..... H01R 13/648 439/108
2007/0246241 A1 * 10/2007 Peterson ..... H01R 4/185 174/74 R
2010/0071953 A1 * 3/2010 Ichio ..... H01R 13/40 174/72 A
2010/0203756 A1 * 8/2010 Omori ..... H01R 31/08 439/507
2011/0287647 A1 * 11/2011 Tamagawa ..... H01R 31/08 439/147
2012/0326698 A1 * 12/2012 Watanabe ..... H01R 31/08 324/66
2013/0267123 A1 * 10/2013 Matsumura ..... H01R 13/46 439/626
2013/0303016 A1 * 11/2013 Shimizu ..... H01R 13/4223 439/374
2013/0305527 A1 * 11/2013 Shimizu ..... H01R 43/20 29/747
2013/0316593 A1 * 11/2013 Shimizu ..... H01R 13/641 439/660
2013/0330956 A1 * 12/2013 Shimizu ..... H01R 13/4223 439/345
2013/0337704 A1 * 12/2013 Nagasaka ..... H01R 13/4223 439/877
2014/0011389 A1 * 1/2014 Shinmi ..... H01R 13/62 439/370
2014/0017929 A1 * 1/2014 Nagasaka ..... H01R 13/4223 439/350
2014/0127928 A1 * 5/2014 Kida ..... H01R 13/4223 439/345
2014/0235090 A1 * 8/2014 Omori ..... H01R 4/64 439/350
2014/0342606 A1 * 11/2014 Endo ..... H01R 13/4223 439/595
2015/0194757 A1 * 7/2015 Osada ..... H01R 13/4223 439/357
2015/0214658 A1 * 7/2015 Nishiyama ..... H01R 24/76 439/357
2015/0222040 A1 * 8/2015 Endo ..... H01R 13/424 439/595

FOREIGN PATENT DOCUMENTS

JP 2012-084405 A 4/2012
JP 2012-134010 A 7/2012

* cited by examiner

CONNECTOR

CROSS REFERENCE TO RELATED APPLICATIONS

This application is a continuation of International Application No. PCT/JP2013/074485, filed Sep. 11, 2013, and based upon and claims the benefit of priority from Japanese Patent Application No. 2012-207779, filed Sep. 21, 2012, the entire contents of all of which are incorporated herein by reference.

TECHNICAL FIELD

This application relates to a connector, and more specifically, relates to a connector in which a flexible locking arm that engages with a terminal has a both-end supported arm.

BACKGROUND

As a conventional connector, one provided with a terminal housing chamber that accommodates a terminal (i.e., female terminal), and a flexible lance (i.e., locking arm) provided on an inner surface of the terminal housing chamber and capable of elastically locking an inserted terminal, in which the lance is formed in a both-end supported state that is supported at both ends and provided with an operating recess that can be operated with a release jig from the outside is proposed in JP3804489 B (PTL 1) or JP 2005-158418 A (PTL 2).

SUMMARY

However, in the conventional connector disclosed in PTL 1 or 2, when the terminal is inserted into the terminal housing chamber, the reactive force of the lance is high and a strong insertion force of the terminal into the terminal housing chamber was necessary. Thus, in order to make the reactive force of the lance low at the time of terminal insertion, it is thinkable to make the front wall that supports a counterpart terminal (male terminal) thin. However, when the front wall that supports the counterpart terminal is made thin, the counterpart terminal may not be securely supported and contact failure and the like may be incurred.

Accordingly, an object of the present invention is to provide a connector which can securely support the terminal and which can make the insertion of the terminal to the terminal housing chamber easy.

A connector according to a first aspect of the present invention includes a substantially box-shaped housing, a female terminal inserted inside the housing, and a busbar supported by the housing. The housing includes a terminal housing chamber in which the terminal is accommodated, a flexible locking arm having elasticity, and a guide wall which guides the busbar within the housing. The locking arm includes a first securing section which secures one end side of the locking arm, a second securing section which secures the other end side of the locking arm, and an arm section which connects the first securing section and the second securing section. A linking part which is provided in a linked manner from the guide wall is integrally formed with the second securing section. The distance between the first securing section and the second securing section is set to be a distance at which an elastic force of the locking arm becomes a desired elastic force.

By integrally forming the linking part which is provided in a linked manner from the guide wall with the second securing section, and setting the distance between the first securing section and the second securing section to be a distance at which an elastic force of the locking arm becomes a desired elastic force, it becomes possible to make the arm section easily bent while securely supporting the female terminal, and the insertion of the female terminal into the housing is made easy to perform.

Preferably a groove portion is provided to the linking part.

By providing the groove portion to the linking part, a longer distance between the first securing section and the second securing section can be secured, and thus, it becomes possible to insert the female terminal into the housing more easily.

Preferably the movement of the female terminal is restricted by the second securing section.

Since the female terminal comes into contact with one face side of the second securing section, it is possible to restrict the movement of the female terminal and damage or frictional wear of the female terminal due to vibration of the connector can be prevented.

DESCRIPTION OF EMBODIMENTS

Figure 1:
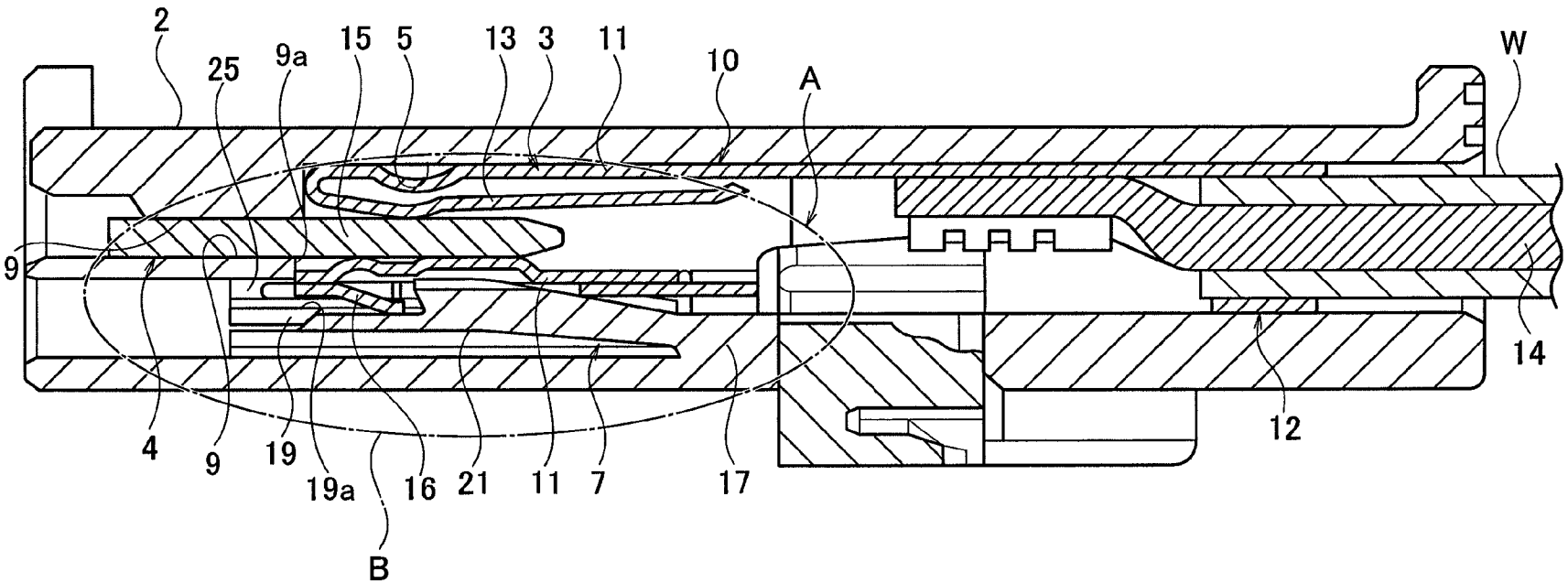
FIG. 1 is a schematic general cross-sectional view of a connector according to an embodiment.
Figure 2:
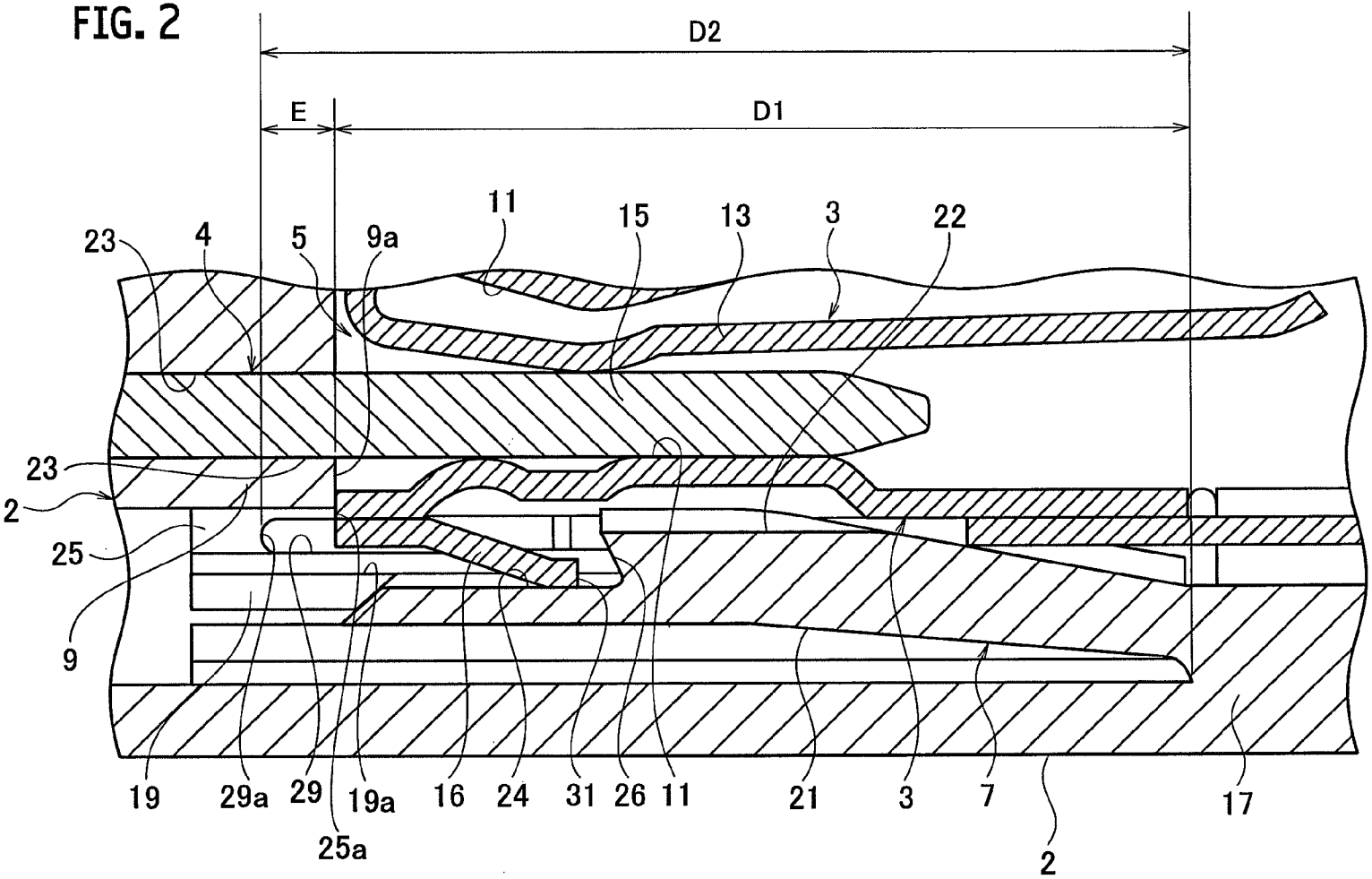
FIG. 2 is an enlarged cross-sectional view of main section A as illustrated in FIG. 1.
Figure 3:
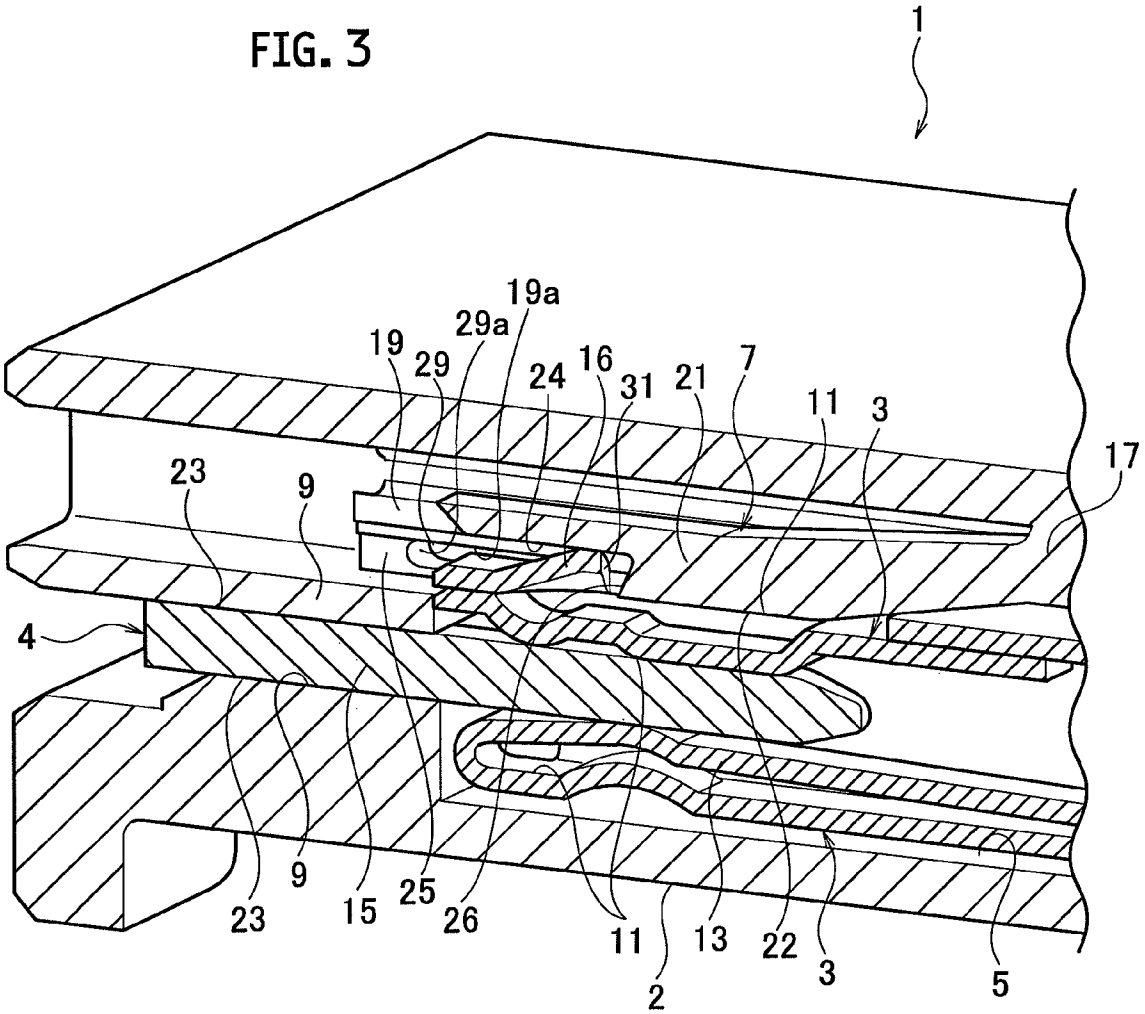
FIG. 3 is a schematic general cross-sectional perspective view of the connector according to the embodiment.

Hereinafter, a connector 1 according to an embodiment of the present invention will be explained in detail by referring to FIGS. 1 to 3.

The connector 1 according to the embodiment includes a substantially box-shaped housing 2, a female terminal 3 inserted inside the housing 2, and a busbar 4 supported by the housing 2.

The housing 2 includes a terminal housing chamber 5 in which the female terminal 3 is accommodated, a flexible locking arm 7 that is deflectable in a direction orthogonal to the insertion direction of the terminal, and a guide wall 9 that supports the busbar 4.

The terminal housing chamber 5 that is formed inside the housing 2 is formed so as to have a space for accommodating the female terminal 3.

The locking arm 7 has elasticity and is formed so as to protrude from one side of the housing 2. The locking arm 7 includes a first securing section 17 at which one end side of the locking arm 7 is secured to one side of the housing 2, a second securing section 19 which provides the other end side of the locking arm 7 in a linked manner from the guide wall 9, and an arm section 21 which connects the first securing section 17 and the second securing section 19.

The arm section 21 connects the first securing section 17 and the second securing section 19. The arm section 21 includes a thick part 22 in which a thickness of the arm section 21 is thick, a thin part 24 that is thinner than the thickness of the thick part 22, and a locking step part 26 formed between the thick part 22 and the thin part 24. To the locking step part 26, an inclined plane for locking the female terminal 3 is provided.

The guide wall 9 is formed in the vicinity of the second securing section 19 and supports the busbar 4. The guide wall 9 includes a guide part 23 that holds and supports the busbar 4, and a linking part 25 that is provided in a linked manner from the guide part 23. To the linking part 25, a groove portion 29 is integrally formed with the second securing section 19 and formed to be dented in the insertion direction of the female terminal 3.

The female terminal 3 is inserted into the terminal housing chamber 5 of the housing 2. The female terminal 3 includes a main body part 10 which is electrically connected to the busbar 4 and a gripping part 12 which grips an electric wire W. The electric wire W includes a core wire 14 inside.

The main body part 10 is inserted by slide-contacting the inner wall of the terminal housing chamber 5. The main body part 10 includes a receiving wall 11 which is inserted in the inner wall of the terminal housing chamber 5, an elastic piece 13 which is formed by being folded back inward from the receiving wall 11, and a folded-back part 16 which is formed by being folded back outward from the receiving wall 11. A distal end 31 of the folded-back part 16 is locked to the locking step part 26 formed at the arm section 21.

The busbar 4 as the male terminal 15 is inserted into the housing 2 from the opposite side of the direction that the female terminal 3 is inserted, and is supported so as to protrude in the terminal housing chamber 5.

Next, a mounting method of the female terminal 3 into the housing 2 will be explained.

First, the busbar 4 is press-fitted into the guide wall 9 from one side of the housing 2, and the busbar 4 is supported by the guide wall 9. At this time, the busbar 4 is press-fitted to a position where it protrudes in the terminal housing chamber 5.

Subsequently, the female terminal 3 is inserted into the terminal housing chamber 5 from an opening at the other side of the housing 2. At this time, the receiving wall 11 of the main body part 10 slide-contacts the inner wall of the terminal housing chamber 5, and the distal end 31 of the folded-back part 16 of the female terminal 3 is inserted into the terminal housing chamber 5 while slide-contacting along the shape of the arm section 21. Further, the folded-back part 16 presses the arm section 21 in a direction orthogonal to the insertion direction and bends the arm section 21. When the arm section 21 bends, the female terminal 3 comes into contact with one face side 19*a* of the second securing section 19 and the movement of the female terminal 3 is restricted.

Further, the distal end 31 of the folded-back part 16 inserted from the other side of the housing 2 passes over the thick part 22 of the arm section 21 and passes over the locking step part 26. Then, the arm section 21 elastically returns and the distal end 31 of the folded-back part 16 is locked to the locking step part 26. Thus, the mounting of the female terminal 3 into the housing 2 is completed.

In the connector 1 according to the embodiment, the linking part 25 which is provided in a linked manner from the guide wall 9 is integrally formed with the second securing section 19, and the distance between the first securing section 17 and the second securing section 19 is set to be a distance D2 at which an elastic force of the locking arm 7 is a desired elastic force. Therefore, it is possible to make the arm section 21 easily bent while securely supporting the female terminal 3, and the insertion of the female terminal 3 into the housing 2 is made easy to perform.

Also, by providing the groove portion 29 to the linking part 25, a longer distance between the first securing section 17 and the second securing section 19 can be secured, and thus, it becomes possible to insert the female terminal 3 into the housing 2 more easily.

That is, by providing the groove portion 29 to the linking part 25, the whole length of the arm section 21 can be made from the distance D1 which is a distance from the first securing section 17 to the end face of the linking part 25*a*, to the distance D2 which is a distance from the first securing section 17 to a bottom wall 29*a* of the groove portion 29, thus extending the distance by a distance E which is a distance from the end face of the linking part 25*a* to the bottom wall 29*a* of the groove portion 29.

Moreover, since the end face of the linking part 25*a* where the groove portion 29 is not formed is formed to be flush with the end face of the guide wall 9*a*, it is possible to make the guide wall 9 for supporting the busbar 4 longer as much as possible, and since the groove portion 29 is formed, the arm section 21 can be made easier to bend.

In addition, when the female terminal 3 is inserted into the terminal housing chamber 5, the arm section 21 bends in a direction orthogonal to the insertion direction, but since the female terminal 3 comes into contact with the one face side 19*a* of the second securing section 19, it is possible to restrict the movement of the female terminal 3 and damage or frictional wear of the female terminal 3 due to vibration of the connector 1 can be prevented.

What is claimed is:

1. A connector, comprising:

a substantially box-shaped housing;

a female terminal inserted inside the housing; and a busbar supported by the housing, the housing comprising:

a terminal housing chamber in which the female terminal is accommodated;

a flexible locking arm having elasticity provided inside the terminal housing chamber;

a guide wall which guides the busbar within the housing; and a linking part which is provided in a linked manner from the guide wall, the locking arm comprising:

a first securing section which secures one end side of the locking arm;

a second securing section which secures the other end side of the locking arm; and an arm section which connects the first securing section and the second securing section, wherein the linking part is integrally formed with the second securing section and a groove portion is provided to the linking part to be dented in the insertion direction of the female terminal thereby the distance between the first securing section and the second securing section is set to be a distance at which an elastic force of the locking arm becomes a desired elastic force.

2. The connector according to claim 1, wherein movement of the female terminal is restricted by the second securing section.

* * * * *